US007082627B2

(12) United States Patent
Marrs et al.

(10) Patent No.: US 7,082,627 B2
(45) Date of Patent: Aug. 1, 2006

(54) EMERGENCY SHOWER SYSTEM

(75) Inventors: James Ellis Marrs, Kingwood, TX (US); Robert James Johnson, Katy, TX (US)

(73) Assignee: ENCON Safety Products Inc., Houston, TX (US)

( * ) Notice: Subject to any disclaimer, the term of this patent is extended or adjusted under 35 U.S.C. 154(b) by 93 days.

(21) Appl. No.: 10/777,924

(22) Filed: Feb. 11, 2004

(65) Prior Publication Data

US 2005/0172396 A1 Aug. 11, 2005

(51) Int. Cl.
*A47K 3/22* (2006.01)

(52) U.S. Cl. ..... 4/605; 4/614; 4/620; 4/900; 251/229

(58) Field of Classification Search ..... 4/604, 4/605, 612, 614, 615, 620, 900; 251/229, 251/279

See application file for complete search history.

(56) References Cited

U.S. PATENT DOCUMENTS 4,084,270 A 4/1978 Kersten, Jr. ..... 4/615
5,768,721 A 6/1998 Kersten ..... 4/614

OTHER PUBLICATIONS

Encon Safety Products, Inc., "Freeze-Resistant Shower"; Specification Sheet, 1 pg., no data given.
Encon Safety Products, Inc., "Through Wall Freeze Resistant Shower"; Specification Sheet, 1 pg., no date given.
Guardian Equipment, "Wall Mounted, Recessed, Barrier-Free Eye-Wash", Product Advertisement, 1 pg., no date given.
Guardian Equipment, "Barrier-Free Wall Mounted Swing-Down Eye/Face Wash in Recessed Stainless Steel Cabinet and Concealed Emergency Shower with Stay-Open Valve"; Specification Sheet, 1 pg., no date given.
Guardian Equipment, "Barrier-Free Combination Emergency Shower and Swing-Down eye/Face Wash with Recessed Stainless Steel Cabinet"; Specification Sheet, 1 pg., no date given.

*Primary Examiner*—Robert M. Fetsuga
(74) *Attorney, Agent, or Firm*—Moore & Van Allen PLLC; Michael G. Johnston

(57) ABSTRACT

An emergency shower system for attachment to a water pipe located behind a wall and a valve mounted to the pipe. The system includes a frame mounted to the wall around the valve, a panel connected to the frame for covering an opening in the wall to expose the valve, the panel having an opening, a plate mounted to the panel to close the panel opening and a handle mounted to the plate. The system also includes a linkage pivotally connected to the plate and to the valve, such that vertical movement of the handle and plate are translated to rotational movement by the linkage so as to operate the valve. There are no openings apparent in the front of the shower system. The handle only moves vertically and at a constant distance of about one and a half inches from the wall. An eye/face wash station may be included with the shower. The eye/face wash station includes a pull down tray with two spray nozzles. The nozzles are connected to another valve which is opened by the rotation of the pull down tray.

17 Claims, 5 Drawing Sheets

EMERGENCY SHOWER SYSTEM

BACKGROUND OF THE INVENTION

CROSS REFERENCE TO RELATED APPLICATIONS

Not applicable.

STATEMENT REGARDING FEDERALLY SPONSORED RESEARCH

Not applicable.

FIELD OF THE INVENTION

The present invention relates to an emergency shower system and more particularly, to an emergency shower system that is easy to operate and to safely integrate into an appropriate environment, such as a laboratory, a school or a municipal, commercial or industrial facility.

DESCRIPTION OF THE RELATED ART

Emergency showers are often used in industry, laboratory and academic environments where researchers, students and workers may be exposed to hazardous materials and/or conditions.

It is important that such emergency showers be easily operated in an emergency situation, where for example, a user may not have use of his/her eyes. The showers must also operate effectively once activated even though they may be seldom used. Further, the shower mechanism must be designed with safety in mind so that there is little likelihood that the structural components of the shower will cause injury at any time and, particularly, during usage.

U.S. Pat. No. 5,768,721 illustrates an example of an existing emergency shower. The patent discloses an emergency shower installed in a recessed area in a wall behind which water pipes are located. A valve mounted to the water pipes is operated by a pivoting handle. The installation covers most but not all of the wall recess into which the shower control mechanism is mounted. The handle is required to move along a path and this necessitates a slot. This slot provides an opening into the recess where the handle mechanism operates and through which water may enter. This water may collect in the recess and behind the wall so that, over a period of time, the collected water may cause damage to the fascia and other structural components of the shower installation and, also, presents a potential for mildew and/or mold problems.

Furthermore, the slot disclosed in U.S. Pat. No. 5,768,721 presents an opening in the front face of the device described there which invites the intentional or unintentional deposit of debris, particularly when the shower device is located in an open environment, such as those presented in a laboratory, a school or a municipal, commercial or industrial facility and the like. Thus, over time, sufficient debris or extraneous objects may be introduced into the recess through the slot opening to prevent complete rotation of the operating handle and, thus, block effective operation of the emergency shower valve during an emergency situation.

Another drawback of a pivoting handle as described in U.S. Pat. No. 5,768,721 is that by its nature the handle moves in an arc which is contrary to current safety practices. Furthermore this arced motion varies the distance that the handle extends outwardly from the adjacent wall. This outward movement may interfere with operation of the handle should a stressed or panicked user not recognize that the handle will first move toward him/her and then away when the handle is rotated from a shower-off to a shower-on position.

BRIEF SUMMARY OF THE INVENTION

The difficulties encountered with previous devices have been overcome by the present invention. What is described here is an emergency shower system which is operable with a fluid delivery apparatus, a shower dispenser connected to the fluid delivery apparatus, a valve connected to the fluid delivery apparatus for controlling the flow of fluid through the fluid delivery apparatus, the system including frame, a panel connected to the frame, the panel having an opening therein, a plate slidably mounted behind the panel for closing the opening in the panel, a handle connected to the plate for moving the plate relative to the covering panel, and a linkage connecting the plate to the valve for operating the shower, the plate and panel covering the linkage and valve.

In a preferred embodiment, the control valve is positioned behind a wall and is accessible through an opening in the wall; the plate is mounted for slidable movement in a substantially linear plane essentially parallel to the wall.

There are a number of advantages, features and objects achieved with the present invention which are believed not to be available in earlier related devices. For example, an object of the present invention is to provide an emergency shower system that is advantageously easy to operate and is safe in its environment after installation. Another object of the present invention is to provide an emergency shower system with an operating handle that extends a minimal distance from an adjoining wall. A further advantage of the present invention is that the emergency shower system has no front facing opening or slot into which water can be introduced that could cause a potential for mildew formation over time.

Another advantage derived from the elimination of the front facing opening or slot in the emergency shower system of the present invention is that no debris can be introduced through the covering panel which could cause interference with movement of the operating handle. In other words, the system mechanism is fully enclosed.

Other features and advantages of the present invention include the provision of an emergency shower system which is simple, reliable and relatively inexpensive.

A complete understanding of the present invention and other objects, advantages and features thereof will be gained from a consideration of the present specification which provides a written description of the invention, and of the manner and process of making and using the invention, set forth in such full, clear concise and exact terms as to enable any person skilled in the art to which it pertains, or with which it is most nearly connected, to make and use the same in compliance with Title 35 U.S.C. section 112 (first paragraph). Furthermore, the following description of preferred embodiments of the invention read in conjunction with the accompanying drawing provided herein represents examples of the invention in compliance with Title 35 U.S.C. section 112 (first paragraph), but the invention itself is defined only by the attached claims.

DETAILED DESCRIPTION OF PREFERRED EMBODIMENTS OF THE INVENTION

Figure 1:
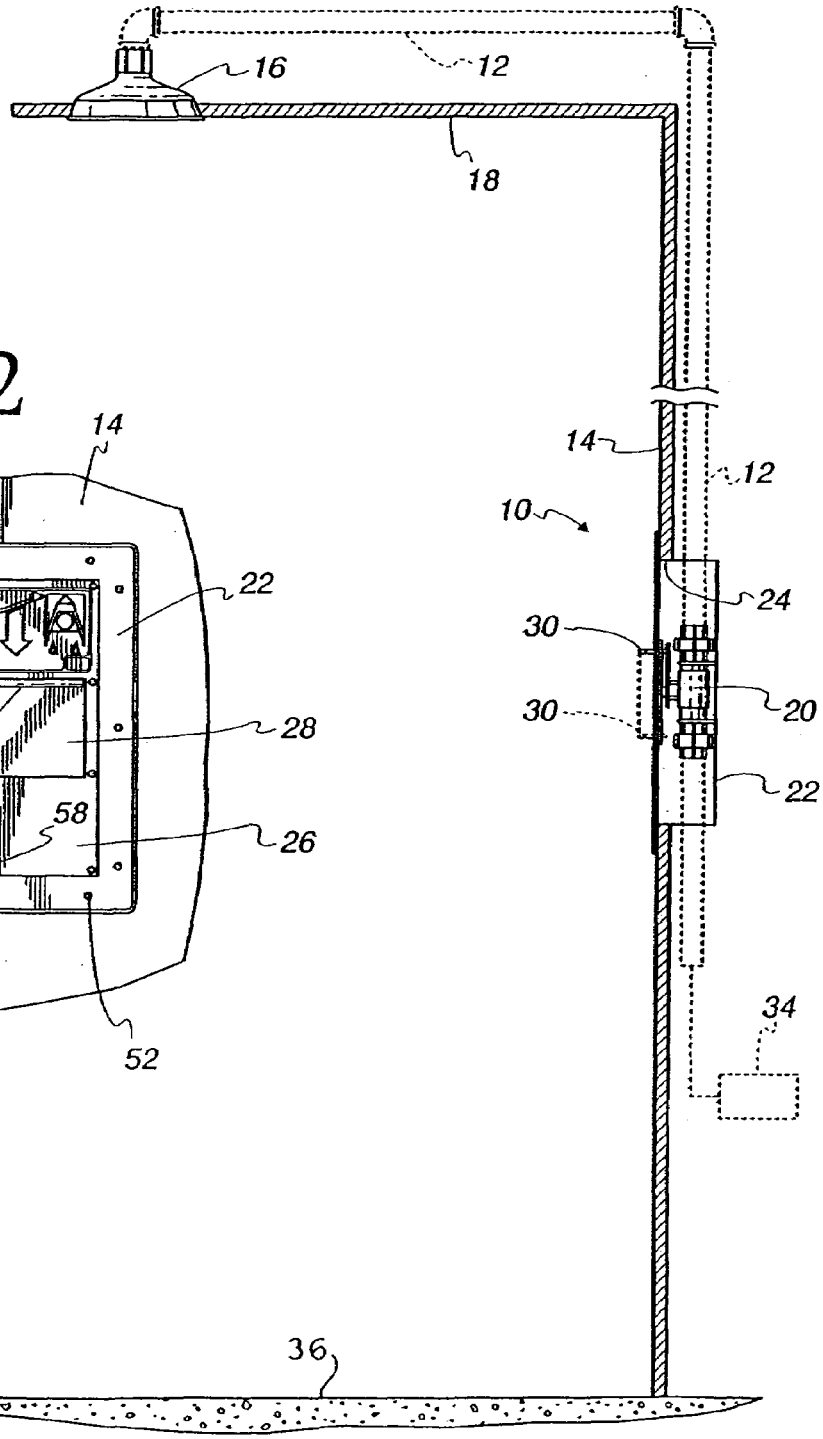
FIG. 1 is a diagrammatic side elevation view of an installed emergency shower system illustrating the positions of an operating handle in both "on" and "off" orientations.

While the present invention is open to various modifications and alternative constructions, the preferred embodiments illustrating the best mode contemplated by the inventors of carrying out their invention are shown in the various figures of the drawing and will be described herein in detail, pursuant to Title 35 U.S.C. section 112 (first paragraph). It is understood, however, that there is no intention to limit the invention to the particular embodiments, forms or examples which are disclosed herein. To the contrary, the intention is to cover all modifications, equivalent structures and methods, and alternative constructions falling within the spirit and scope of the invention as expressed in the appended claims, pursuant to Title 35 U.S.C. section 112 (second paragraph).

Figure 2:
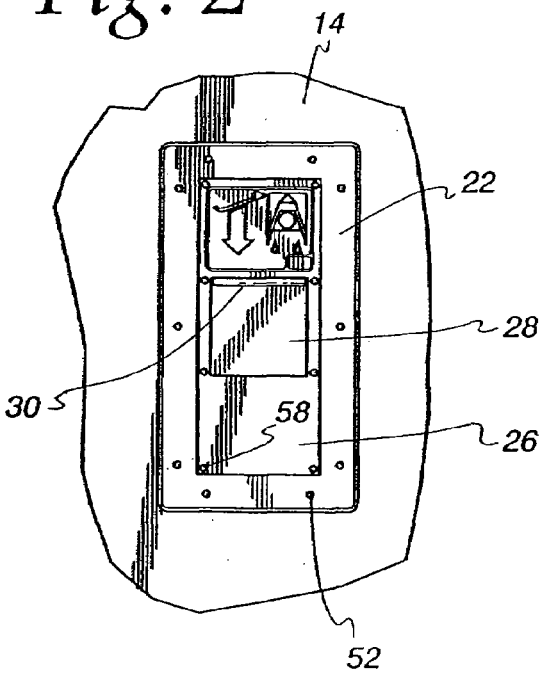
FIG. 2 is a diagrammatic front elevation view of a portion of the emergency shower system illustrated in FIG. 1 as it would appear to potential shower users.
Figure 3:
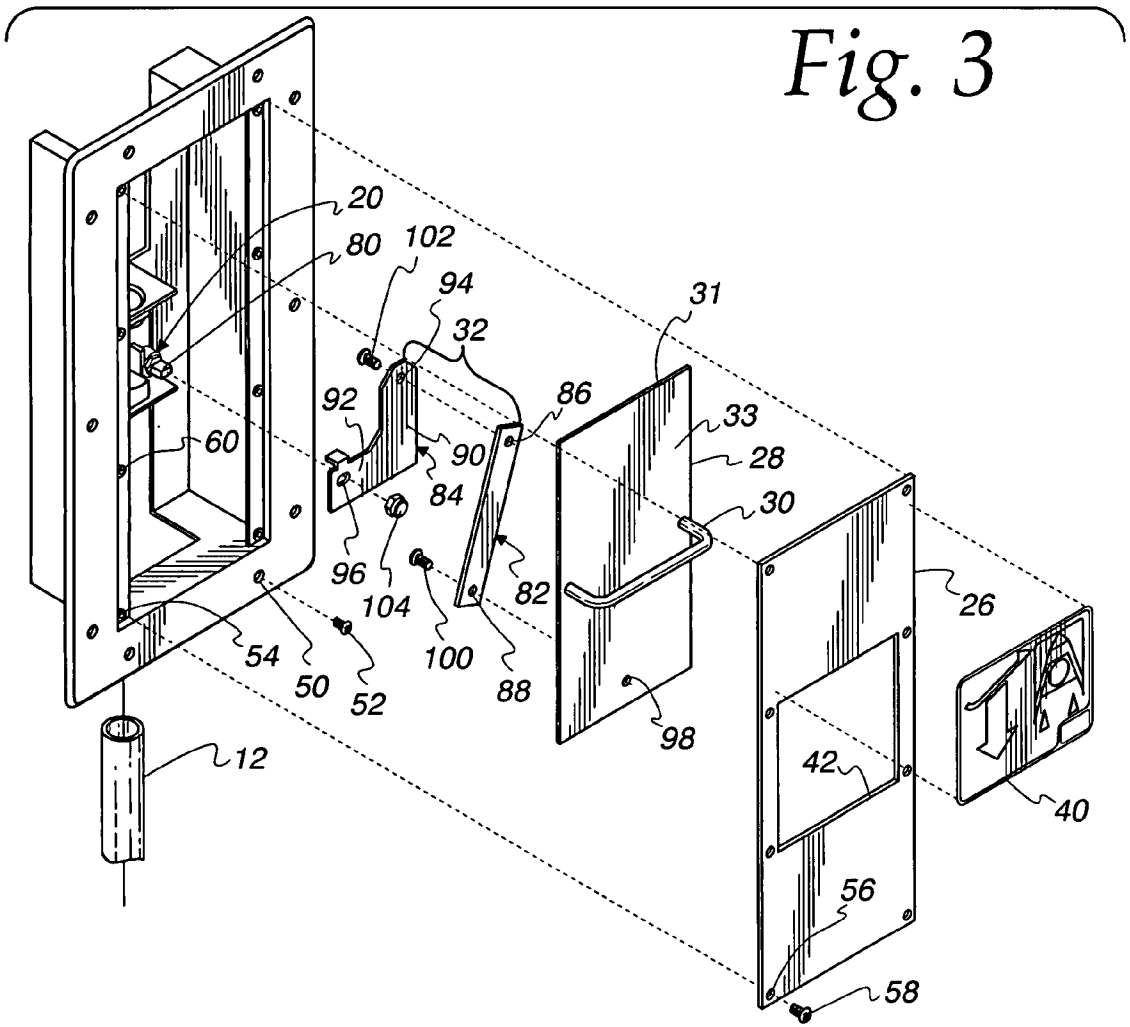
FIG. 3 is an enlarged, exploded, partially broken-away isometric view of the emergency shower system illustrating the shower system's operating mechanism.

Referring now to FIGS. 1–3, an emergency shower system 10 is illustrated in a typical installation. The emergency shower system is connected to a fluid delivery apparatus such as water pipes 12 mounted behind a wall 14 with water flow being controlled by a valve 20. Water is dispersed from a shower head 16 mounted flush with a ceiling 18. The system includes a frame 22 in an opening 24 formed in the wall 14, a cover panel 26 mounted to the frame 22, a plate 28 slidably mounted behind to the cover panel 26, a shower operating handle 30 attached to the plate 28, and a linkage 32 connected to the plate 28 and to the valve 20 to translate linear motion of the handle and the plate to rotating motion for the valve. The plate has an inner surface 31 and an outer surface 33.

It is to be understood that the system may also include the valve and shower head. Usually the water pipes are a preexisting part of a building structure. However, the system may include an entire installation including water pipes, a wall and an opening formed in the wall.

The shower head 16 is shown flush with the ceiling 18 although it should be recognized that within the scope of the present invention, the shower dispenser head 16 may extend outwardly from the wall 14 or extend downwardly from the ceiling 18 if so desired. The shower head 16 is directly connected to the water pipes 12.

The pipes extend from a source 34, usually a potable water supply such as a municipal water main, which is brought in from under a building structure and then extended behind the wall 14 to connect to the shower head. Beneath the shower head is a floor 36 which may have an arrangement for a drain (not shown).

The valve 20 is positioned behind the wall and is connected in line with the pipes. The valve is operable to prevent the passage of water when the shower is in an "off" or "closed" mode and allows the passage of water when the shower is in an "on" or "open" mode. Mounted around the valve and adjoining pipes is the frame 22 which is inserted into the opening 24 in the wall 14 and is attached to the wall by any suitable fasteners. The cover panel 26 is mounted to the frame 22 and mounted to the panel is a pictograph 40 illustrating how the handle 30 is to be operated. Beneath the pictograph is a rectangular opening 42 which provides access to the plate 28. The handle 30 allows a user to slide the plate relative to the panel and thereby operate the shower system.

An important feature of the emergency shower system 10 is that there is no opening available to allow the introduction of water or debris through the wall opening which could cause mildew formation or could interfere with the effective functioning of the valve 20 or the linkage 32. The frame 22, the panel 26 and the plate 28 effectively block all access through the wall opening. More particularly, there is no slot or other opening as in the above mentioned patent.

This construction overcomes the serious drawback presented by the handle slot, whereby water or other liquid could enter the recess and present a mildew forming condition or an object or some other form of debris could be stuck into the slot and prevent operation of the emergency shower assembly. As may be best seen in FIG. 2, the present system is fully enclosed and no openings are presented to a user or to a passing person who would be beyond the outer surface 33 of the plate, i.e., someone positioned in front of the system so that the system appears to that person as it is depicted in FIG. 2.

Referring now to the detail illustrated in FIG. 3, it is noted that the frame 22 is positioned in front of a portion of the pipes 12 as well as the valve 20 and provides ready access to the valve. It is noted that the pipes and the valve may be offset and placed behind the wall adjacent the frame and the wall opening, if desired. The frame 22 includes a series of holes, such as the hole 50, for receiving fasteners, such as a screw 52, to allow the frame to be attached to the wall 14. Holes, such as the hole 54 in the frame and hole 56 in the panel are provided to receive fasteners, such as a screw 58, to attach the panel to the frame. Spacers, such as a spacer 60, provide room for the sliding plate and act as plate guides.

The handle 30 may be attached to the plate 28 in any convenient fashion, such as with the use of fasteners (not shown).

The valve 20 may be of a standard ball type with a stem 80 projecting in an outwardly horizontal direction. A suitable valve is made by Conbraco Industries, Inc. of Matthews, N.C. and sold under the APOLLO brand, Model 70-105-01.

Pivotally mounted to the plate 28 is the linkage 32. The linkage includes a first or front link 82 and an L-shaped second or rear link 84. A pair of openings 86, 88 are located at the end portions of the link. The rear link 84 has a vertical arm portion 90 and a horizontal arm portion 92, each with an opening 94, 96 at end portions thereof. The lower opening 88 of the front link 82 allows the front link to be pivotally connected to the plate, which also has an opening 98, with a fastener 100. The upper opening 86 of the front link 82 allows the front link to be pivotally connected to the vertical arm portion 90 of the rear link 84 with a fastener 102 through the opening 94. The horizontal arm portion 92 of the rear link 84 is mounted to the stem 80 of the ball valve by having the stem inserted into the opening 96 and retained there by a fastener 104. It may now be appreciated that vertical movement of the plate causes rotational movement of the ball valve stem by way of the linkage. In this way, a light force on the handle of the plate is magnified by the linkage to rotate the valve stem.

Figure 4:
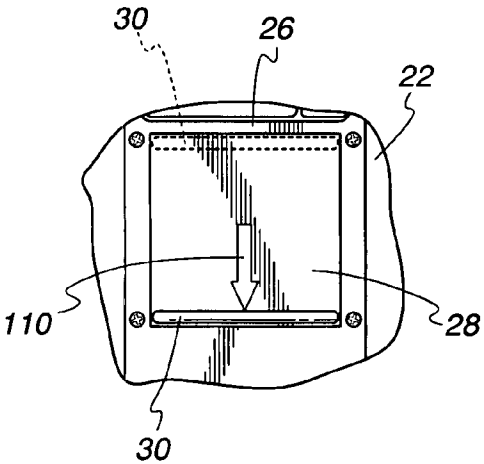
FIG. 4 is a diagrammatic elevation view of the operating handle on a plate of the emergency shower system shown in FIGS. 1–3 illustrating the locations of the handle in a shower-off position (broken line) and in a shower-on position (solid line).
Figure 5:
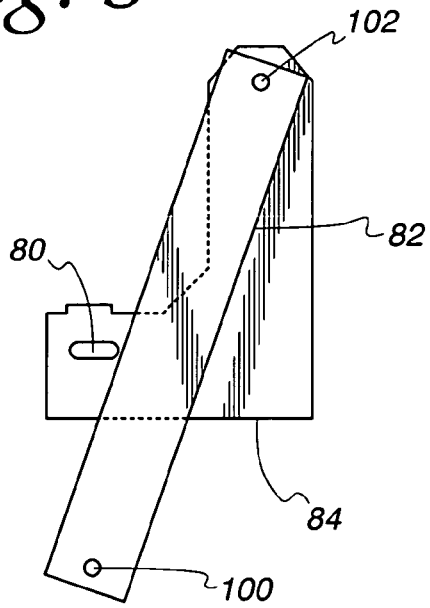
FIG. 5 is a diagrammatic elevation view of a linkage alignment when the emergency shower system is in the shower-off position.
Figure 6:
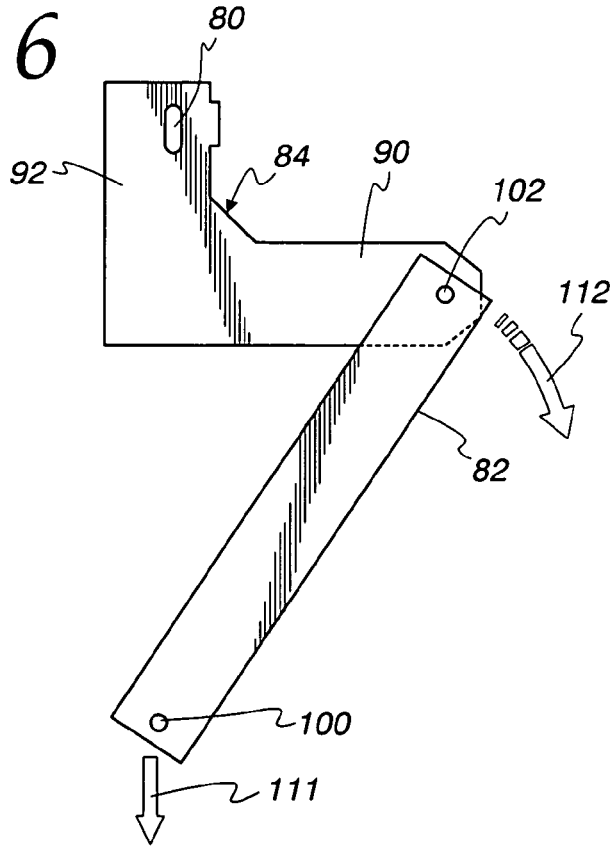
FIG. 6 is a diagrammatic elevation view of the linkage alignment when the emergency shower system is in the shower-on position.
Figure 7:
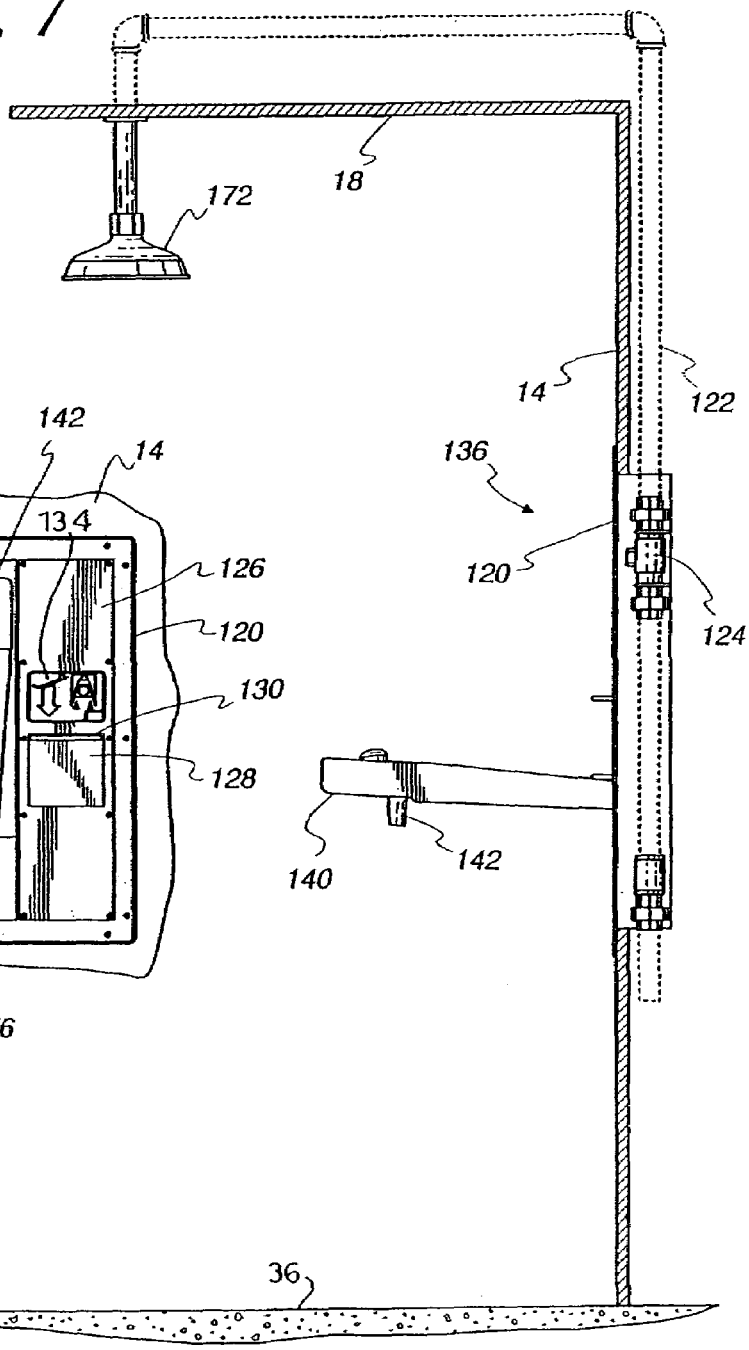
FIG. 7 is a diagrammatic side elevation view of an installed emergency shower system with a combined eye/face wash station in an open position.

In FIGS. 4–6, the operation of the shower is shown in more detail. Vertical movement of the handle from an upper position, shown in broken line in FIG. 4, downwardly, as depicted by an arrow 110, to the lower position shown in solid line is sufficient movement by a shower user to cause the shower to go from "off" when the handle is in its upper position to "on" when the handle is in its lower position.

When the handle is in its upper position, the links 82, 84 are shown generally in the position illustrated in FIG. 5. In this position, the valve stem 80 is disposed in a horizontal orientation. However, when the handle and the plate are moved vertically downwardly, the fastener 100 in the bottom portion of the front link and the bottom portion of the plate is pulled downwardly as depicted by an arrow 111, causing the fastener 102 in the upper portion of the front link to pivot the vertical arm portion 90 of the rear link 84. This causes the rear link 84 to rotate clockwise as depicted by an arrow 112 about the connection of the arm portion 92 and the valve stem 80. The vertical movement of the handle, which is approximately 4.85 inches, causes a rotational movement of the ball valve stem of approximately ninety degrees.

The ball valve is designed so that when the valve stem 80 is horizontally oriented, the valve blocks or closes the pipes to the passage of any water. However, when the valve stem is rotated, a passage is opened through the valve for the water in the pipes to flow to the shower head.

Manipulating the handle 30 is very convenient and requires little force and movement to turn the shower to "on". There is little friction in the linkage system and the links are long enough to provide sufficient torque to the valve stem 80 so that rotation is simple and easy. It is to be noted that the handle moves parallel to the panel and does not swing outwardly in an arc as is the situation with some shower devices.

The handle is sufficiently large to be easily gripped by a user and extends only about one and a half inches from the wall so that the handle does not interfere with the normal operation of a laboratory or manufacturing plant, such as when someone walks past the wall where the emergency shower system is installed. Hence, the emergency shower system may be mounted in a hallway. It is also noted that the handle and linkage are simple, reliable and relatively inexpensive.

It is to be understood that a fluid other than water may flow through the pipes, or water may be mixed with chemicals, if desired.

In operation of the emergency shower system of the present invention, an individual who, for example, has accidentally encountered an emergency situation such as a hazardous substance spill or leak and the like, immediately goes to the emergency shower system installation and while positioned under the showerhead pulls the shower operating handle downwardly. This short, vertical, downward motion is translated by the linkage to rotational motion so as to rotate the ball valve from a closed position to an open position, thereby allowing water to flow from the source through the pipes to the showerhead. To cause the shower to go from "on" to "off", a user merely lifts the handle back to its original, upper position.

The above specification describes in detail one preferred embodiment of the present invention. In an alternative preferred embodiment, as illustrated in FIGS. 7–10, an optional eye/face wash section is combined with the shower apparatus to form a combined emergency shower system. In such an arrangement, the structure and operation of the shower portion of the system is essentially the same as the above described system and as illustrated in FIGS. 1–6. In the FIGS. 7–10 embodiment 136 there is an enlarged frame 120 in front of pipes 122 and a valve 124. A panel 126, a plate 128, a handle 130, a linkage 132 and a pictograph 134 are connected to the frame. Adjacent to the shower is an eye/face wash station 138. Included in the eye/face wash station is a pull down tray 140, an operating handle 142, a pair of water nozzles 144, 146, a branch pipe 148, a second valve 150, a supply pipe 152, a hook 154 and an access panel 156.

Figure 8:
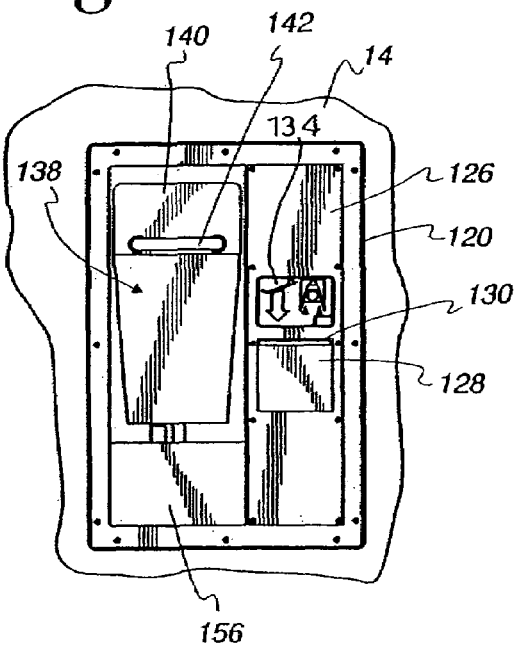
FIG. 8 is a diagrammatic front elevation of a portion of the combined system shown in FIG. 7 with the eye/face wash station in a closed position.
Figure 10:
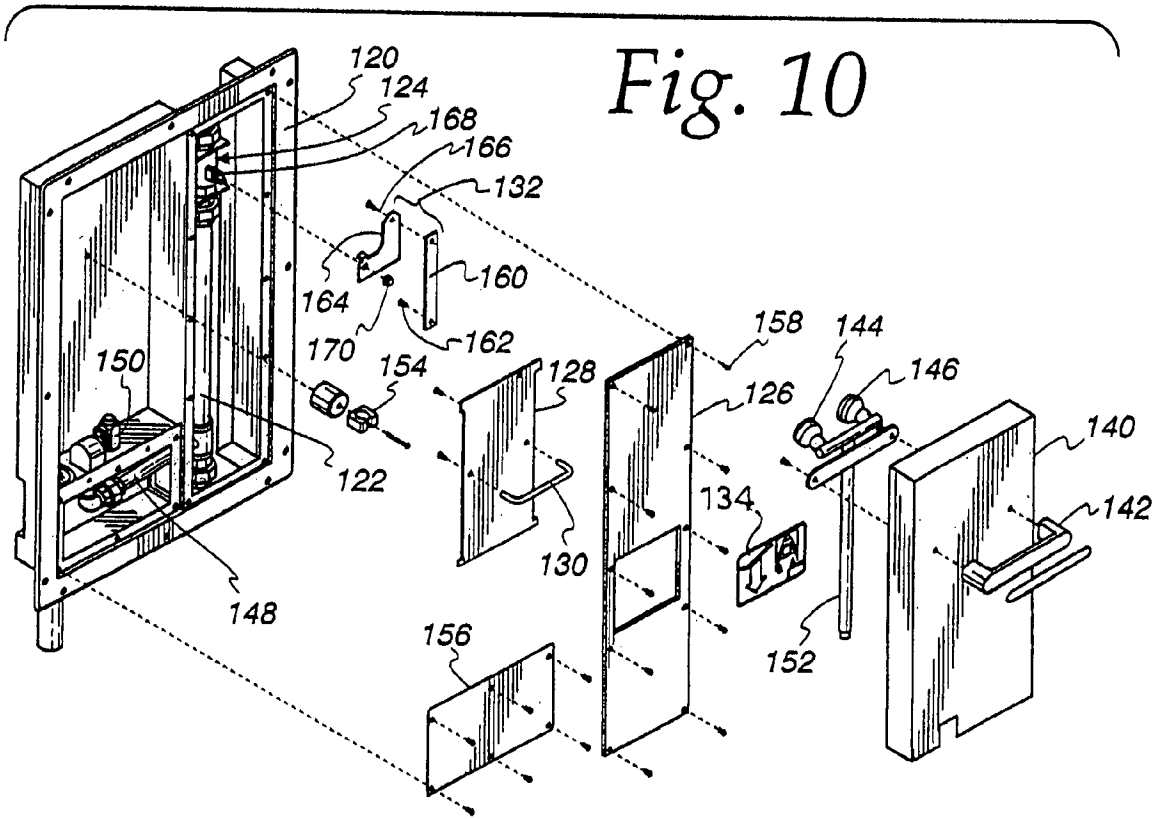
FIG. 10 is an enlarged, exploded, isometric view of the combined system shown in FIGS. 7–9.
Figure 9:
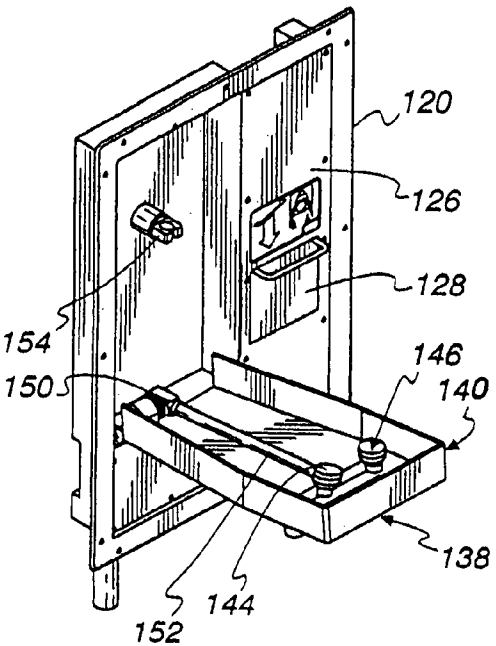
FIG. 9 is an isometric view of a portion of the combined system shown in FIGS. 7 and 8 illustrating the eye/face wash station of the combined system in an open, operating position.

In greater detail, the cover panel 126 of the shower station is mounted to the frame 120 by screw fasteners 158 on the right side of the system, and the optional eye/face wash station 138 is mounted to the frame for rotatable movement on the left side of the system. The supply pipe 152 is connected to the valve 150 which is rotated from a closed position to an open position when the tray 140 is rotated from its up, folded position as shown in FIGS. 8 and 10 to its down, operating position shown in FIGS. 7 and 9. The branch pipe 148 extends off the main pipe 122 to feed water to the eye/face wash station. The handle 142 is fastened to the front or underside of the tray to move the tray from its "up" vertical position to its "down" horizontal position. The handle 142 of the eye/face wash station extends about one and a half inches from the tray, essentially the same distance as the handle 130 of the shower. Hence, there is minimal impediment to the area around the system.

Specifically, operation of the eye/face wash station of the emergency shower system is activated by moving the tray from its up position to its down position. During this maneuver of rotating the tray approximately ninety degrees, the valve 150, illustrated as a ball valve, goes from a closed position to an open position where water is delivered to the pair of nozzles 144, 146 which are ideally situated to wash a user's eyes and face and thereby dilute and wash away hazardous chemicals. To turn the water off on the left side of the system, the tray is lifted from the horizontal, down position to the vertical, up position during which the second valve moves from an open position to a closed position.

The plate 128 of the shower system is attached to pivot a front link 160 by a fastener 162 and the front link is pivotally attached to a rear link 164 by a fastener 166. The rear link is attached to a valve stem 168 by a fastener 170. Vertical movement of the plate 128 by a downward pull of the handle 130, rotates the links and opens the valve 124. This causes water to flow in the pipes 122 behind the wall 14 to a shower dispenser head 172 suspended below the ceiling 18.

The above specification describes in detail preferred embodiments of the present invention. Other examples, embodiments, modifications and variations will, under both the literal claim language and the doctrine of equivalents, come within the scope of the invention defined by the appended claims. For example, whether the showerhead is located as shown or flush with the ceiling or the wall or in some other disposition is considered an equivalent as are different handle shapes or dimensions, or shapes and dimensions of the linkage. The type of valve used may be changed to an equivalent structure. The fluid in the pipes may be water, a chemical or a mix of both. Still other alternatives will also be equivalent as will many new technologies. There is no desire or intention here to limit in any way the application of the doctrine of equivalents nor to limit or restrict the scope of the invention.

The invention claimed is:

1. An emergency shower system operable with a fluid, a fluid delivery apparatus, a dispensing shower head and a valve for controlling the flow of fluid, the system comprising:

a frame having an opening to provide access to the valve;

a panel mounted over said frame opening and having a panel opening;

a plate movable adjacent said panel to close said panel opening, said plate being movable relative to said panel between two positions;

a handle connected to said plate for moving said plate;

a linkage connecting said plate to said valve whereby movement of said plate between said two positions causes operation of said valve; and said plate and said panel being structured and dimensioned to collectively cover said frame opening.

2. The system as claimed in claim 1 wherein:

said frame mounts to a wall having an opening.

3. The system as claimed in claim 1 wherein:

said plate moves vertically between said two positions; and said linkage translates the vertical movement of said plate to rotational movement at said valve.

4. The system as claimed in claim 3 wherein:

said linkage includes a front link pivotally connected to said plate and a rear link pivotally connected to said front link and to said valve.

5. The system as claimed in claim 4 wherein:

said handle extends away from said plate about one and a half inches.

6. The system as claimed in claim 5 including:

an eye/face wash station, said station including a rotatable tray, two spray nozzles mounted to said tray, a second valve connected to said tray, said valve being operated by said rotatable tray.

7. The system as claimed in claim 1 wherein said handle extends away from said plate about one and a half inches.

8. The system as claimed in claim 1 including:

an eye/face wash station, said station including a rotatable tray, two spray nozzles mounted to said tray, a second valve connected to said tray, said valve being operated by said rotatable tray.

9. The system as claimed in claim 1 wherein:

said linkage includes first and second links which are pivotally connected to said plate, to said valve and to each other.

10. The system as claimed in claim 1 wherein:

said plate is mounted to move vertically.

11. The system as claimed in claim 1 wherein:

said handle moves parallel to said panel during movement of said plate.

12. The system as claimed in claim 1 including:

an eye/face wash station having a rotatable tray, a pair of fluid dispensers and a valve, said tray being movable from a closed generally vertical position to an open generally horizontal position.

13. The system as claimed in claim 1 wherein:

said plate is mounted to move vertically; and said handle moves parallel to said panel during movement of said plate.

14. The system as claimed in claim 13 wherein:

said linkage includes first and second links which are pivotally connected to said plate, to said valve and to each other.

15. The system as claimed in claim 14 including:

an eye/face wash station having a rotatable tray, a pair of fluid dispensers, a valve, and a delivery apparatus connected to said valve and to said pair of dispensers, said tray moving from a closed generally vertical position to an open generally horizontal position.

16. An emergency shower system comprising:

a pipe adapted to be connected to a fluid source, said pipe being located behind a wall and said wall having an opening;

a valve connected to said pipe;

a showerhead connected to said pipe;

a frame connected to said wall in said opening, said frame having an opening;

a panel mounted over said frame opening, said panel having an opening;

a movable plate mounted to said panel for closing said panel opening;

a handle mounted to said plate for moving said plate in a vertical direction; and a linkage pivotally connected to said plate and to said valve for translating vertical motion of said plate to rotational motion at said valve.

17. The system as claimed in claim 16 including:

an eye/face wash station having a pull down tray and a spray nozzle.

* * * * *